US006058722A

United States Patent [19]

Choi

[11] Patent Number: 6,058,722

[45] Date of Patent: May 9, 2000

[54] AIR CURTAIN FAN DRIVING DEVICE AND METHOD FOR A REFRIGERATOR

[75] Inventor: Byung-Joon Choi, Incheon, Rep. of Korea

[73] Assignee: Daewoo Electronics Co., Ltd., Seoul, Rep. of Korea

[21] Appl. No.: 09/221,131

[22] Filed: Dec. 28, 1998

[30] Foreign Application Priority Data

Oct. 30, 1998 [KR] Rep. of Korea ..... 98-46141

[51] Int. Cl.[7] ..... F25D 17/06

[52] U.S. Cl. ..... 62/153; 62/156; 62/186; 62/256; 62/131

[58] Field of Search ..... 62/80, 82, 151, 62/153, 156, 131, 255, 256, 275, 276, 282, 408, 186

[56] References Cited

U.S. PATENT DOCUMENTS

| | | | |
|---|---|---|---|
| 2,558,997 | 7/1951 | Voelker | 62/255 |
| 4,299,092 | 11/1981 | Ibrahim | 62/256 |
| 4,327,557 | 5/1982 | Clarke et al. | 62/153 |
| 4,379,391 | 4/1983 | Rhee | 62/408 |
| 5,228,300 | 7/1993 | Shim | 62/80 |
| 5,791,152 | 8/1998 | Choi | 62/89 |
| 5,816,054 | 10/1998 | Yoo et al. | 62/80 |

*Primary Examiner*—Harry B. Tanner
*Attorney, Agent, or Firm*—Jacobson, Price, Holman & Stern, PLLC

[57] ABSTRACT

A reference temperature of the cooler is set which is required to moderate an interior temperature of the refrigerator. During a defrosting mode, if a door is opened, then a control part switches on an air curtain fan if a temperature of a cooler is lower than the reference temperature, or switches it off if it is not lower. The control part switches off the air curtain fan when the door is closed. Meanwhile, during the defrosting mode, if the door is closed, then the control part switches on the air curtain fan if the temperature of the cooler is lower than the reference temperature in a heating state, or switches it off if it is not lower. The air curtain fan is also switched off if it is not in a heating state. Thus, the air curtain fan is driven depending on interior and exterior conditions during a defrosting operation of the refrigerator. Thereby, refrigerating efficiency as well as defrosting efficiency are increased.

2 Claims, 4 Drawing Sheets

AIR CURTAIN FAN DRIVING DEVICE AND METHOD FOR A REFRIGERATOR

BACKGROUND OF THE INVENTION

1. Field of the Invention

The present invention relates to a refrigerator, and more particularly to an air curtain fan driving device and a method for driving an air curtain fan according to interior and exterior conditions during a defrosting operation of a refrigerator.

2. Description of the Prior Art

Generally, the normal operation of the refrigerator is carried out while the mode is appropriately changed into a cooling mode for cooling the interior of the refrigerator or a defrosting mode for defrosting frost formed on the cooler.

Viewing the refrigerant circulation cycle in a refrigerator, as a gas refrigerant with high-temperature and high-pressure created by a compressor passing through a condenser, the gas refrigerant transmits its heat to the exterior and is converted into liquid refrigerant. Thereafter, the liquid refrigerant, which still has high pressure, passes through a dryer, so that foreign materials and the water component in the liquid refrigerant are removed, and the liquid refrigerant without the foreign materials and water moves to the capillary tube. The liquid refrigerant moving through the capillary tube expands in a liquid/gas-mixed state to easily evaporate, thereby absorbing ambient heat in order for the refrigerant to return to the original refrigerant condition. Accordingly, the refrigerant is repeatedly circulated as a cooling air supply in the refrigerator.

Meanwhile, during the cooling operation of the refrigerator, frost is formed on the cooler since the temperature in the refrigerator changes by opening the door of the refrigerator. The amount of frost is determined by the operating time of the compressor, external temperature, the frequency in door opening of the refrigerator, external humidity, and the time the door remains open. Frost formed on the cooler causes a decrease in cooling efficiency.

Accordingly, a microprocessor of the refrigerator changes the mode into the defrosting mode when more frost than the predetermined amount is formed. The defrosting mode comprises a pre-cooling step, a heating step, a compressor pausing step, and a cooling fan pausing step. The pre-cooling step is for lowering the temperatures of the refrigerating compartment and the freezing compartment of the refrigerator before driving the heater. The heating step is to carry out the defrosting operation. The compressor pausing step is for pausing the compressor drive to prevent it from overheating. The cooling fan pausing step is for pausing the cooling fan drive until the cooler is cooled under the predetermined temperature.

During operation of the refrigerator, the interior temperature of the refrigerator may rise due to an overload in the refrigerating compartment of the refrigerator and if the exterior air flows in the refrigerating compartment while the refrigerating compartment door is opened. At this time, in order to restore the interior temperature of the refrigerating compartment to its normal state, an air curtain fan has been mounted in the refrigerating compartment in recent years.

A temperature control method for refrigerator is disclosed, in U.S. Pat. No. 5,263,332 granted to Mr. Park on Nov. 23, 1993, for reducing the cooling time by stabilizing the temperature fluctuation occurring when the refrigerator door is opened. The patent includes a step for controlling a compressor and a fan for a normal operation in order to maintain interior temperature of a refrigerator at a temperature preset by a user (called "normal operation step"). In a door-opening control step, if opening of a door of the refrigerator is detected, the fan is turned off, and a time period during the opening of a door of the refrigerator is calculated until closing of the door is detected. Thereafter, if the closing of the door is detected, a temperature-resetting step restarts the normal operation step after automatically resetting the preset temperature based on the calculated time period. A reset temperature operation step determines whether the temperature is reset during the normal operation step. If the temperature is reset, the compressor and the fan are driven for a cooling operation until the temperature reaches reset temperature. Thereafter, the reset temperature operation step restarts the normal operation step. The patent of Mr. Park enhances food preservation and the efficiency of the refrigerator since the interior temperature influenced by exterior air when a door of the refrigerator has been opened is rapidly stabilized after the closing of the door.

Hereinafter, a conventional air curtain fan driving device will be described in detail with reference to FIG. 1. FIG. 1 is a view for showing a conventional air curtain fan driving device. The conventional air curtain fan driving device 10 includes an air curtain fan 100, a temperature detector 102, a compressor 104, a compressor driver 106, a cooling fan 108, a cooling fan driver 110, an air curtain fan driver 112, and a controller 114.

The temperature detector 102 detects an interior temperature T1 of the refrigerator under the control of the controller 114. The detection of the interior temperature T1 of the refrigerator is applied to the controller 114. The compressor 104 converts normal gas refrigerant into gas refrigerant of high temperature and high pressure. The compressor driver 106 controls the driving of the compressor 104. The cooling fan 108 blows cool air into the refrigerating compartment. The cooling air is provided from the evaporator (not shown). The cooling fan driver 110 controls the driving of the cooling fan 108. The controller 114 controls the operations of the temperature 102, compressor driver 106, cooling fan driver 110, and air curtain fan driver 112. The controller 114 causes normal cooling operations to be performed since the controller 114 drives the compressor 104 and cooling fan 108 by the compressor driver 106 and cooling fan driver 110 respectively. The controller 114 determines whether the interior temperature T1 of the refrigerating compartment detected by the temperature detector 102 is normal.

Hereinafter, operations of the conventional air curtain fan driving device will be described in detail.

FIG. 2 is a flow chart for explaining operations of the conventional air curtain fan driving device of FIG. 1.

When electric power is applied, the controller 114 drives the compressor 104 and cooling fan 108 by means of the compressor driver 106 and cooling fan driver 110 respectively, so that normal cooling operations are performed (step S201). The temperature detector 102 detects an interior temperature T1 of the refrigerator under the control of the controller 114 (step S202). The detected interior temperature T1 is transmitted to the controller 114. The controller 114 determines whether the detected interior temperature T1 is a normal temperature by the temperature detector 102 (step S203). If the detected interior temperature T1 is below or over the normal temperature as a result of the determination of the step S203, the compressor driver 106 drives the compressor 104 under the control of the controller 114 (step S204). Thereafter, the cooling fan driver 108 and the air curtain fan driver 112 drive the cooling fan 108 and the air curtain fan 100 under the control of the controller 114 respectively (step S205). In step 206, the controller 114 determines again whether the detected interior temperature T1 by the temperature detector 102 is the normal temperature. If the detected interior temperature T1 is below or over the normal temperature as a result of the determination of the step S206, the step S204 is restarted.

In the meantime, if the detected interior temperature T1 is determined as the normal temperature, the controller 114 enables the normal cooling operations to be performed (S207).

With the conventional method mentioned above, the air curtain fan is driven when the door of the refrigerator is opened regardless of the interior condition of the refrigerator, i.e., regardless of whether the operating mode is the cooling one or the defrosting one.

The air curtain fan is driven even in the defrosting mode when the door of the refrigerator is opened. That is to say, in the heating step of the defrosting mode, the temperature of the cooler can be higher than the required temperature in the normal cooling operation. If the air curtain fan is operated in this case, then air of a higher temperature passing through the cooler flows into the refrigerating compartment and the freezing compartment, which causes a decrease in cooling efficiency.

SUMMARY OF THE INVENTION

It is an object of the present invention to provide an air curtain fan driving device for a refrigerator for driving an air curtain fan according to interior and exterior conditions during a defrosting operation of a refrigerator.

It is another object of the present invention to provide an air curtain fan driving method for a refrigerator for driving an air curtain fan according to interior and exterior conditions during a defrosting operation of a refrigerator.

In order to achieve the above objects, the air curtain fan driving device of the present invention includes a door opening/closing detection part, a cooler temperature determining part, a heating part, a compressor driving part, a cooling fan driving part, an air curtain fan driving part, and a control part.

The door opening/closing detection part detects the opening and closing of a door of the refrigerator. The cooler temperature determination part determines temperature of a cooler. The heating part outputs a control signal for driving a defrosting heater. The compressor driving part outputs a control signal for driving a compressor. The cooling fan driving part controls driving operation of a cooling fan. The air curtain fan driving part controls a driving operation of an air curtain fan. The control part is for driving the air curtain fan driving part by comparing a temperature of the cooler with a reference temperature of the cooler according to signals from the door opening/closing detection part and the cooler temperature determination part.

In order to achieve the above objects, an air curtain fan driving method according to the present invention includes (a) a step for setting a reference temperature of the cooler which is required to moderate an interior temperature of the refrigerator;

(b) a step for detecting opening/closing of a door if in a defrosting mode;

(c) a step for switching on the air curtain fan if the temperature of the cooler is lower than the reference temperature, or switching it off if the door is opened;

(d) a step for switching off the air curtain fan when the door is closed;

(e) a step for checking whether it is in a heating state or not when the door is closed in the defrosting mode;

(f) if in the heating state, a step for switching on the air curtain fan if the temperature of the cooler is lower than the reference temperature, or switching it off; and (g) a step for switching off the air curtain fan if it is not in the heating state.

In the air curtain fan driving method of the present invention, if opening of the door in the defrosting mode is detected, then the air curtain fan is driven only when the temperature of cooler is lower than the reference temperature, or when the air curtain fan is not driven.

Therefore, when the temperature of the cooler is increased over a predetermined temperature by operation of the defrosting heater, the air curtain fan is not driven even though the door is opened, whereby air of higher temperature via the cooler does not flow into the refrigerating compartment.

Furthermore, if the closing of the door in the defrosting mode is detected, then the air curtain fan is driven when the temperature of the cooler is lower than the reference temperature in heating by the defrosting heater. Since driving of the air curtain fan in heating by the defrosting heater takes the coldness of the cooler more quickly, the defrosting operation is more quickly carried out. Therefore, efficiency of the defrosting operation is increased. Moreover, when the temperature of the cooler is higher than the reference temperature in heating by the defrosting heater, the air curtain fan is not driven, which prevents increase in the temperature of the refrigerating compartment.

BRIEF DESCRIPTION OF THE DRAWINGS

These and other objects and features of the present invention can be understood through the following embodiment by reference to the accompanying drawing, in which.

DETAILED DESCRIPTION OF THE PREFERRED EMBODIMENTS

Figure 1:
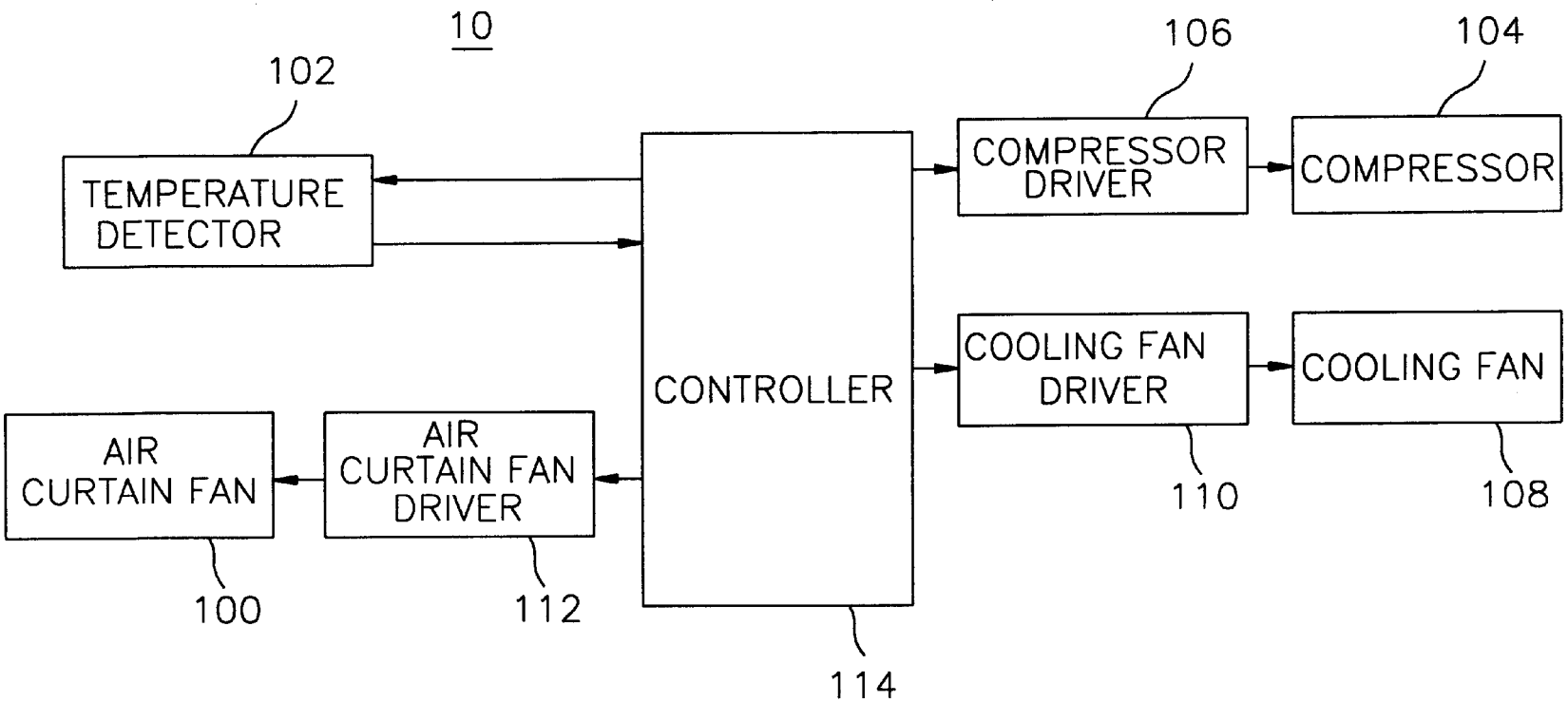
FIG. 1 is a block diagram for showing a conventional air curtain fan driving device for a refrigerator.
Figure 2:
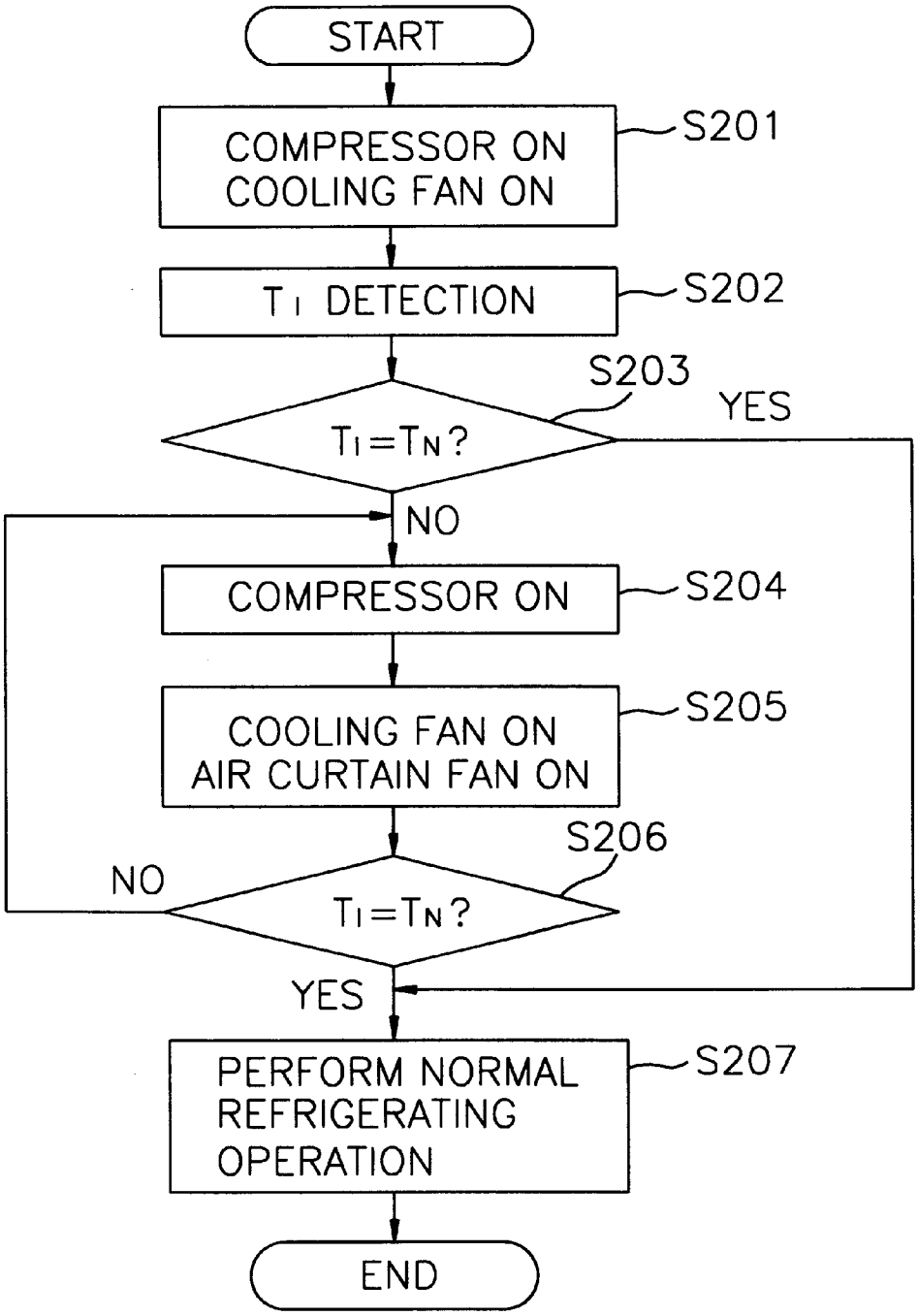
FIG. 2 is a flow chart for explaining operations of the conventional air curtain fan driving device of FIG. 1.
Figure 3:
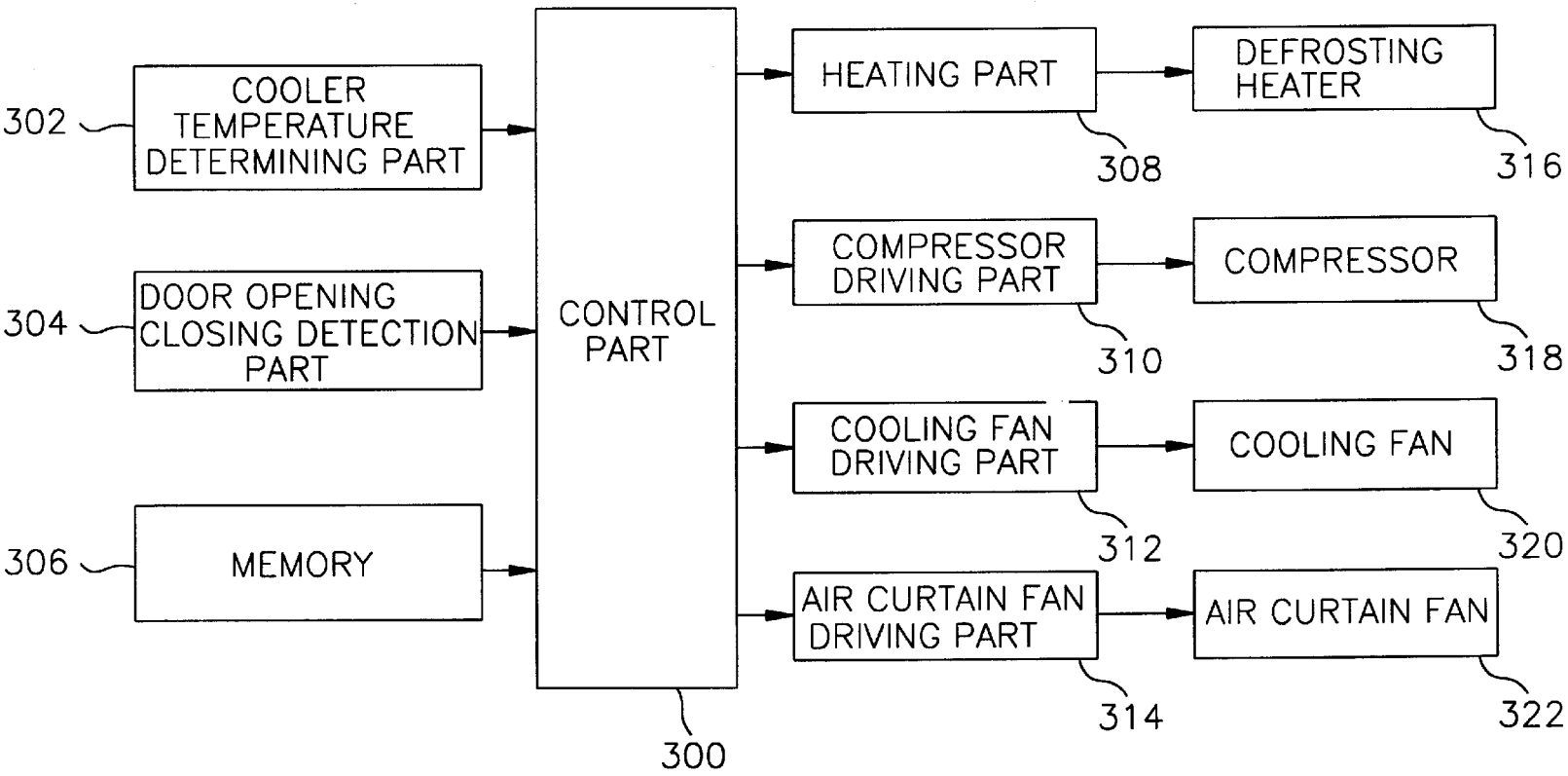
FIG. 3 is a block diagram for showing an air curtain fan driving device for a refrigerator according to an embodiment of the present invention.

Hereinafter, the air curtain fan driving device according to an embodiment of the present invention will be described in detail with reference to the accompanying drawings. FIG. 3 is a block diagram for showing an air curtain fan driving device 30 for a refrigerator according to an embodiment of the present invention.

The device 30 includes a cooler temperature-determining part 302, a door opening/closing detection part 304, a memory 306, a heating part 308, a compressor driving part 310, a cooling fan driving part 312, an air curtain fan driving part 314, a defrosting heater 316, a compressor 318, a cooling fan 320, an air curtain fan 322, and a control part 300.

The cooler temperature determination part 302 determines a temperature of a cooler.

The door opening/closing detection part 304 detects whether the door of the refrigerator is opened or closed by a predetermined switching circuit.

In the memory 306 a reference temperature is set which is required to moderate the interior temperature of the refrigerator.

The control part 300 controls the signals inputted from the respective parts depending on the interior program and controls the general operation of the refrigerator by outputting predetermined signals.

The heating part 308 outputs a control signal for driving a defrosting heater 316 depending on the control signal from the control part 300.

The compressor driving part 310 outputs a control signal for driving a compressor 318 depending on the control signal from the control part 300.

The cooling fan driving part 310 controls the driving operation of the cooling fan 314.

The air curtain fan driving part 310 controls the driving operation of the air curtain fan 322.

Figure 4:
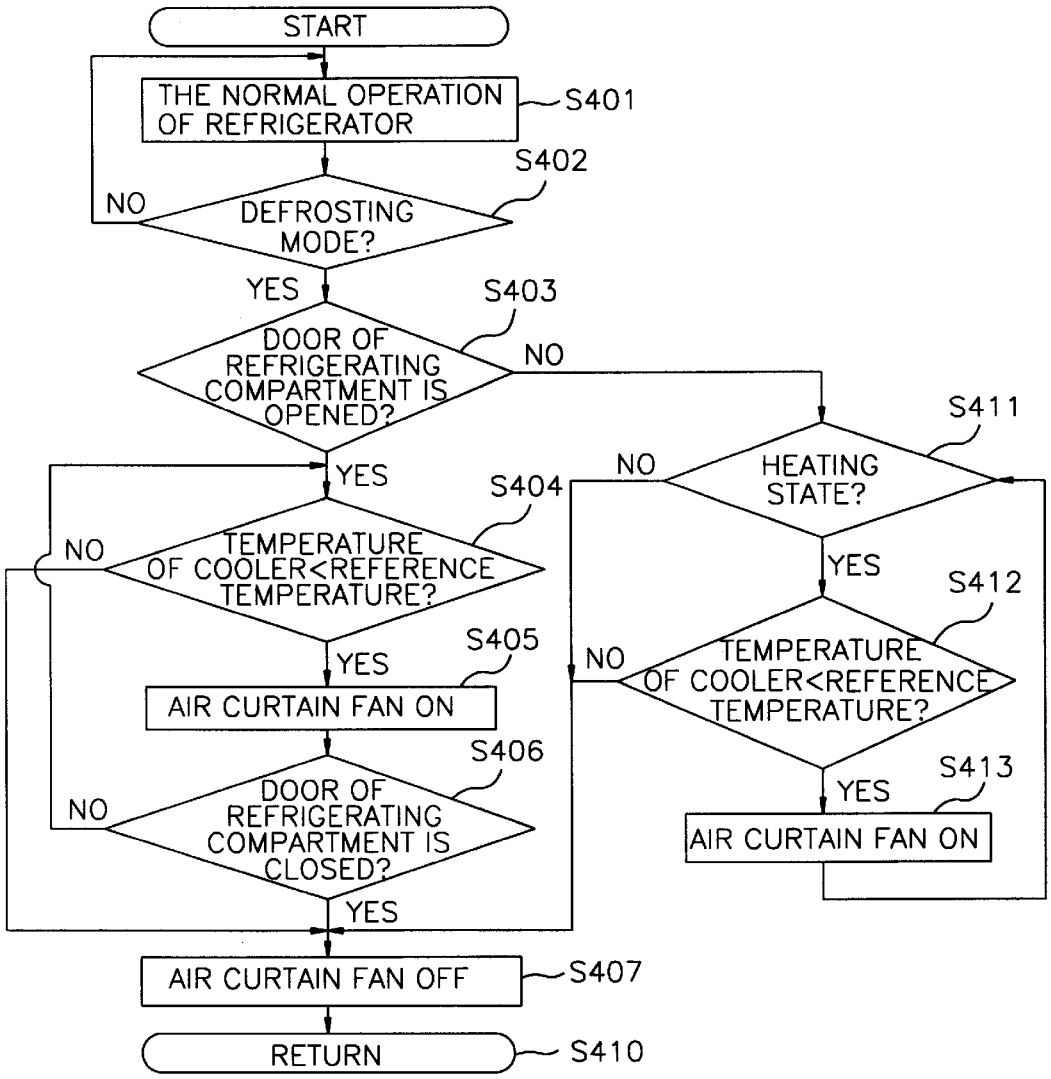
FIG. 4 is a flow chart for explaining operations of the air curtain fan driving device for a refrigerator according to the embodiment of the present invention.

Hereinafter, the air curtain fan driving method according to the embodiment of the present invention will be described in detail with reference to FIG. 4. FIG. 4 is a flow chart for explaining the air curtain fan driving method of a refrigerator according to the embodiment of the present invention.

When the refrigerator is powered on, the normal operation of the refrigerator is carried out by the control part 300 while the mode is appropriately changed into a cooling mode or a defrosting mode (step S401). In the cooling mode, the compressor 318 cools the interior of the refrigerator. In the defrosting mode the defrosting heater 316 defrosts frost formed on the cooler. Furthermore, if the door of the refrigerator is opened, then the control part 300 drives the air curtain fan 322, and if the door of the refrigerator is closed, then the control part 300 stops the air curtain fan 322. Thus, the refrigerator maintains the temperature of the refrigerating compartment at from −1° C. to 5° C. and the temperature of the freezing compartment at −25° C.

A reference temperature Tr which is required to moderate the interior temperature of the refrigerator is set by a predetermined method to be stored in the memory 306. For example, the reference temperature Tr can be set by the manufacturer when the refrigerator is manufactured or set by the user when the user sets the interior temperature of the refrigerator by any desired temperature.

In step S402, the control part 300 checks whether the mode is in the defrosting mode during the normal operation of the refrigerator.

If in the defrosting mode, in step S403, the control part 300 receives the opening signal from the door opening/closing detection part 304 when the door is opened.

In step S404, the control part 300 compares the temperature of the cooler with the reference temperature when the door is opened. The control part 300 switches on the air curtain fan 322 if the temperature of the cooler is lower than the reference temperature Tr (step S405). If the control part 300 receives the closing signal from door opening/closing detection part 304, then the control part 300 switches off the air curtain fan 322 (step S407).

In step S403, if the door is closed in the defrosting mode, then the control part 300 checks whether it is in a heating state or not.

In step S411, if it is in the heating state, then the control part 300 compares the temperature of the cooler with the reference temperature (step S411).

In step S412, if the temperature of the cooler isn't lower than the reference temperature, then the control part 300 switches off the air curtain fan (step S407). In step S412, if the temperature of the cooler is lower than the reference temperature, then the control part 300 switches on the air curtain fan (step S413), and performs step S412 and step S413 repeatedly. That is, the control part 300 switches on the air curtain fan if the temperature of the cooler is lower than the reference temperature during the heating state. Meanwhile, the control part 300 switches off the air curtain fan if the temperature of the cooler isn't lower than the reference temperature or if the heating state is closed.

If the air curtain fan is switched off, the refrigerator returns to its normal operation (step S410).

In the air curtain fan driving method of the present invention, if opening of the door in the defrosting mode is detected, then the air curtain fan is driven only when the temperature of the cooler is lower than the reference temperature, or the air curtain fan is not driven.

Therefore, when the temperature of the cooler is increased over a predetermined temperature by the operation of the defrosting heater, the air curtain fan is not driven even though the door is opened, whereby air of a higher temperature via the cooler does not flow into the refrigerating compartment.

Furthermore, if closing of the door in the defrosting mode is detected, then the air curtain fan is driven when the temperature of the cooler is lower than the reference temperature through heating by the defrosting heater. Since driving of the air curtain fan in heating by the defrosting heater takes the coldness of the cooler more quickly, the defrosting operation is carried out more quickly. Therefore, efficiency of the defrosting operation is increased. Moreover, when the temperature of cooler is high than the reference temperature in heating by the defrosting heater, the air curtain fan is not driven, which prevents an increase in the temperature of the refrigerating compartment.

It is understood that various other modifications will be apparent to, and can be readily made by those skilled in the art without departing from the scope and spirit of this invention. Accordingly, it is not intended that the scope of the claims appended thereto be limited to the descriptions set forth herein, but rather that the claims be constructed to encompass all the features of the patentable novelty that reside in the present invention, including all the features that would be treated as equivalent thereof by those skilled in the art to which this pertains.

What is claimed is:

1. An air curtain fan driving device for a refrigerator comprising:

a door opening/closing detection part for detecting the opening and closing of a door of the refrigerator;

a cooler temperature determination part for determining a temperature of a cooler;

a heating part for outputting a control signal for driving a defrosting heater;

a compressor driving part for outputting a control signal for driving a compressor;

a cooling fan driving part for controlling a driving operation of a cooling fan;

an air curtain fan driving part for controlling a driving operation of an air curtain fan; and a control part for driving the air curtain fan driving part by comparing the temperature of the cooler with a reference temperature of the cooler according to signals from the door opening/closing detection part and the cooler temperature determination part.

2. An air curtain fan driving method for a refrigerator comprising:

(a) a step for setting a reference temperature of the cooler which is required to moderate an interior temperature of the refrigerator;

(b) a step for detecting opening/closing of a door if in a defrosting mode;

(c) a step for switching on the air curtain fan if the temperature of the cooler is lower than the reference temperature, or switching it off if the door is opened;

(d) a step for switching off the air curtain fan when the door is closed;

(e) a step for checking whether it is in a heating state or not when the door is closed in the defrosting mode;

(f) if in the heating state, a step for switching on the air curtain fan if the temperature of the cooler is lower than the reference temperature, or switching it off; and (g) a step for switching off the air curtain fan if it is not in the heating state.

* * * * *